US009816784B2

(12) United States Patent
Adamson et al.

(10) Patent No.: US 9,816,784 B2
(45) Date of Patent: Nov. 14, 2017

(54) WEAPON SYSTEM CONTROL HANDLE

(71) Applicant: ELBIT SYSTEMS OF AMERICA, LLC, Fort Worth, TX (US)

(72) Inventors: David Earl Adamson, Delray Beach, FL (US); John Orth Weber, II, Deerfield Beach, FL (US); Hua Yang, Lake Worth, FL (US)

(73) Assignee: Elbit Systems of America, LLC, Fort Worth, TX (US)

( * ) Notice: Subject to any disclaimer, the term of this patent is extended or adjusted under 35 U.S.C. 154(b) by 350 days.

(21) Appl. No.: 14/748,784

(22) Filed: Jun. 24, 2015

(65) Prior Publication Data

US 2015/0377589 A1 Dec. 31, 2015

Related U.S. Application Data

(60) Provisional application No. 62/018,314, filed on Jun. 27, 2014.

(51) Int. Cl.

| | |
|---|---|
| ***F41G 5/06*** | (2006.01) |
| ***F41G 5/24*** | (2006.01) |
| ***F41G 5/14*** | (2006.01) |
| ***F41A 19/69*** | (2006.01) |
| ***G05G 9/047*** | (2006.01) |

(52) U.S. Cl.

CPC ..... *F41G 5/06* (2013.01); *F41A 19/69* (2013.01); *F41G 5/14* (2013.01); *F41G 5/24* (2013.01); *G05G 9/047* (2013.01); *G05G 2009/04774* (2013.01); *Y10T 74/20012* (2015.01); *Y10T 74/20207* (2015.01)

(58) Field of Classification Search

CPC .... F41G 5/06; F41G 5/14; F41G 5/24; G05G 9/047; G05G 2009/04774; B64C 13/04; F41A 19/69; F41A 19/58; H01H 2009/066; Y10T 74/20207; Y10T 74/20012; Y10T 74/20612

See application file for complete search history.

(56) References Cited

U.S. PATENT DOCUMENTS

| | | | | |
|---|---|---|---|---|
| 5,472,156 A * | 12/1995 | Bivens, III | ..... | B64C 13/04 244/229 |
| 7,271,796 B1 * | 9/2007 | Moll | ..... | G05G 25/02 244/234 |
| 8,090,481 B2 * | 1/2012 | McMahon | ..... | B64C 13/04 244/236 |

* cited by examiner

*Primary Examiner* — Ryan Johnson

(57) ABSTRACT

An apparatus. The apparatus includes electrical circuitry for selectably controlling a first and a second weapon system different from the first weapon system. The electrical circuitry includes a first switch including a first pole and a second pole. The apparatus also includes a first connector having a first terminal coupled to a common terminal of the first pole. A second connector has a first terminal coupled to a common terminal of the second pole. The first connector is configured to couple to a first weapon system mounted on a mobile platform; and the second connector is configured to couple to a second weapon system mounted on the mobile platform. The first weapons system is configured to operate when the first switch is in a first position and the second weapon system is configured to operate when the first switch is in a second position.

8 Claims, 7 Drawing Sheets

WEAPON SYSTEM CONTROL HANDLE

CROSS-REFERENCE TO RELATED APPLICATIONS

This application is related to and claims the benefit of U.S. Provisional Patent Application Ser. No. 62/018,314 filed 27 Jun. 2014 titled "Weapon System Control Handle", which is hereby incorporated by reference as if fully set forth herein.

TECHNICAL FIELD

The present invention relates to apparatus for operating a weapon system and, in particular, to apparatus for operating multiple weapons systems by a single operator.

BACKGROUND

Modern combat arms may deploy multiple weapons systems on a single platform. For example, a battle tank may deploy armaments in addition to its main gun. Each of these may present a separate operation and control apparatus to the operator. A single control assembly that provides a single point of control for multiple weapons systems would be advantageous to the operator.

BRIEF DESCRIPTION OF THE DRAWINGS

For a detailed description of various embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

"Double pole double throw" (DPDT) shall mean a configuration of switchable contacts that have a pair of poles, each of which can switch an independent circuit, and each pole includes a common contact and a pair of switched contacts one of which is "normally open" and the other "normally closed". When used in the context of a relay, a normally open contact is one that is open when the relay is un-energized, and the normally closed contact is one that is closed when the relay is un-energized. Upon energizing the relay, the normally open contact closes, and vice versa with respect to the normally closed contact. Normally open and normally closed may equivalently be used in the context of electrical terminals that provide a connection to the contacts by a circuit.

"Pre-existing form factor" as used in conjunction with a controller handle shall mean the form, fit and mechanical architecture of a control handle currently deployed in a weapons system platform.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
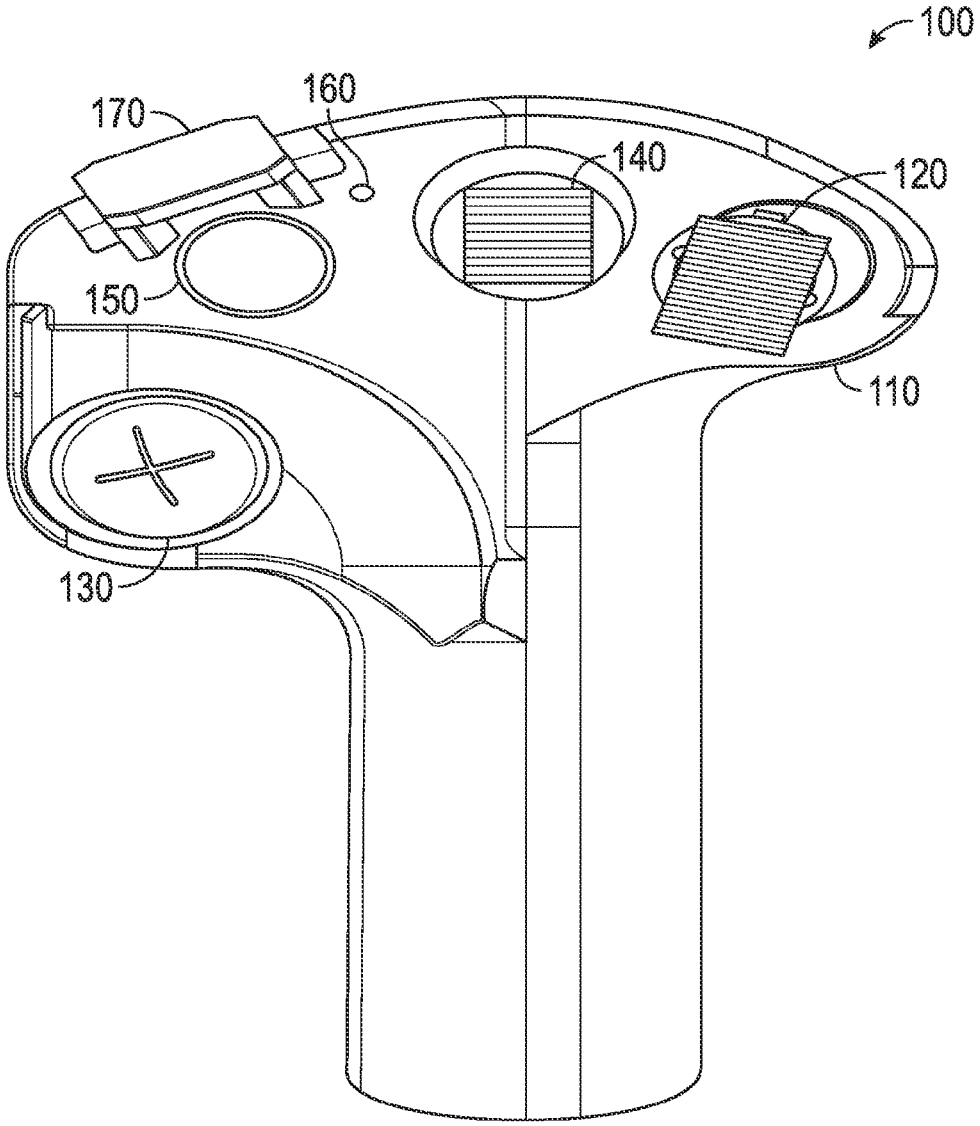
FIG. 1 shows a front elevation view of a weapon system control handle in accordance with at least some embodiments.

Refer now to FIG. 1 illustrating a front elevation view of a weapon system control assembly handle 100 in accordance with at least some embodiments. Control assembly handle 100 includes a housing 110. A switch 120 may be disposed within housing 110. As will be described further below in conjunction with FIGS. 5 and 6, switch 120 may be coupled to electrical circuitry disposed within an internal volume of weapons system control assembly handle 100 (not shown in FIG. 1). Switch 120 may allow an operator to select between weapons systems to be controlled with the weapons system control assembly. In the various embodiments described below, switch 120 may comprise different electrical embodiments, however, the functionality and mechanical configuration in FIG. 1 may be the same.

In at least some embodiments, weapons system control assembly handle 100 may include additional devices to control a plurality of weapons systems as selected in response to operator positioning of switch 120. For example, weapons system control assembly handle 100 may include a cursor (or "trackball") 130 to control the positioning of a selected weapons system. By way of further example, consider an embodiment of a weapons system control assembly in accordance with the principles of the disclosed embodiments used in conjunction with weapons system platform such as an M1A1 main battle tank. The tank may have, in addition to its main gun, a weapon system used by the tank commander, which may be comprised of, for example, a heavy machine gun disposed within a mechanized platform (which may be referred to as a Stabilized Commander's Weapon Station or "SCWS") that allows for remote positioning and firing of the machine gun. In such an embodiment, cursor 130 may be used by the operator to position the SCWS in azimuth and elevation by rotation of cursor 130.

Other devices that may be included are switches 140 and 150. Continuing with the exemplary embodiment of a weapons system control assembly handle 100 used in conjunction with a main battle tank, switch 120 may be used to select functionality of the SCWS. For example, in a first position, switch 140 may select "slew" and in a second position may select "track." In the SCWS mode, switch 120 may select functionality that parallels the slew-to-queue operation of the main gun, or may select laser rangefinder functionality, both commands are prompted at switch 150. Switch 150 may be a push button device used to control the range of the main gun. In such an embodiment, the function of switch 150 may be controlled by the setting of switch 120, as described further below in conjunction with FIGS. 5 and 6. For example, when switch 120 is set to select the main gun weapons system, switch 150 may then control the laser rangefinder of the main gun. Alternatively, when switch 120 is positioned to select the SCWS, switch 150 may then control the "slew-to-queue" function of the main gun. The slew-to-queue function may allow the operator to command the main gun in traverse to target independent of the laser rangefinder. In at least some embodiments as described further below, switch 150 may comprise a single-pole single-throw (SPST) momentary contact switch. In some other embodiments, also described further below, switch 150 may comprise a double-pole single-throw (DPST) switch. A light emitting diode (LED) 160 may be provided to signal to the operator, the position setting of switch 120. LED 160 may be illuminated when switch 120 is set to select the SCWS weapons system and extinguished when switch 120 is set to select the main gun system. Conversely, in an alternative embodiment, LED 160 may be illuminated when the main gun system is selected and extinguished when the SCWS system is selected. A cover 170 (shown in its open position) may be provided. Cover 170 may be used to preclude access to switch 150.

Figure 2:
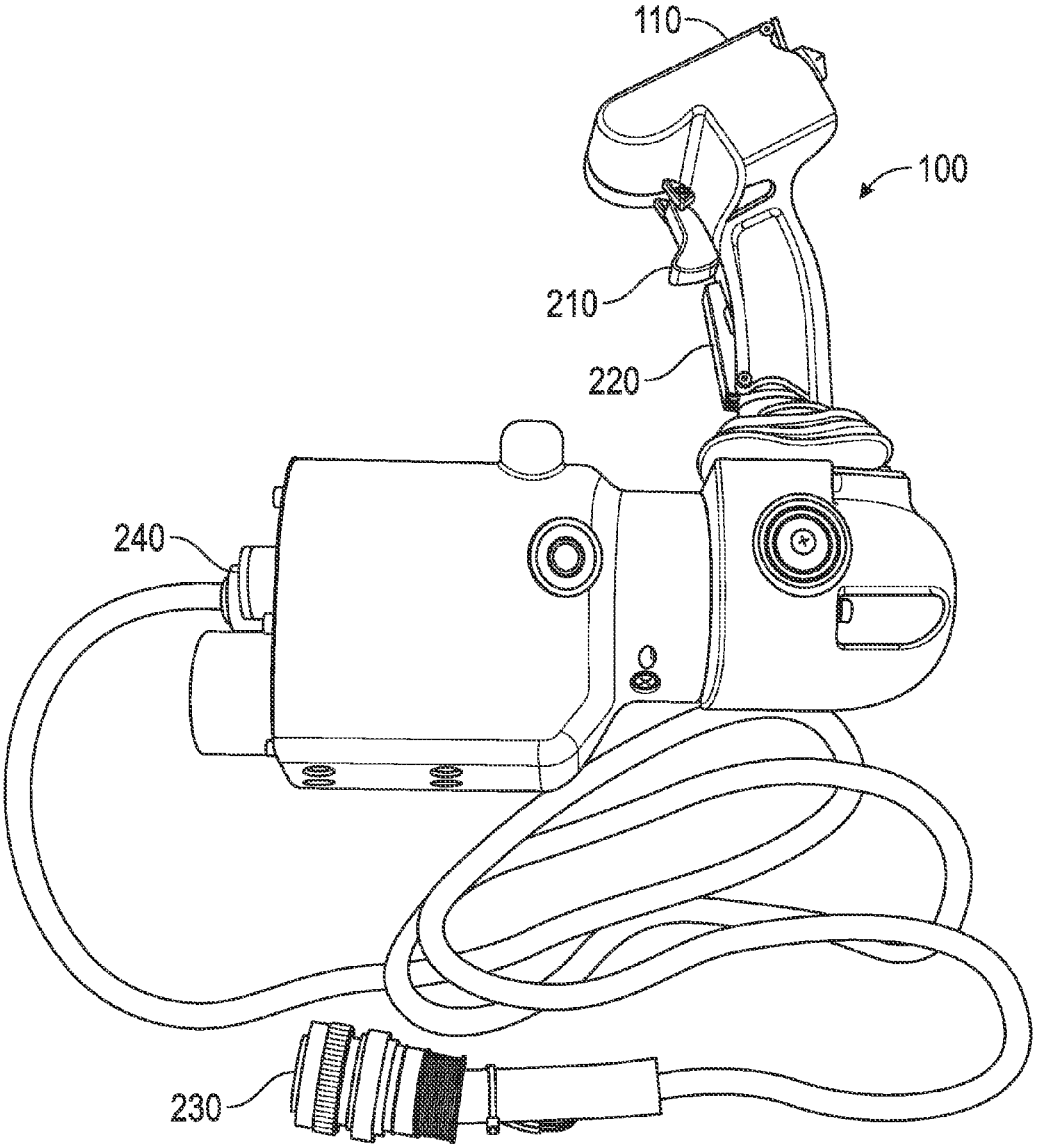
FIG. 2 shows a right side view of a weapons system control handle in accordance with at least some embodiments.

Turning now to FIG. 2, there is illustrated therein a right side view of weapons system controller handle 100. As seen in FIG. 2, weapons system control handle includes a trigger switch, trigger 210, and a palm switch 220, not visible in FIG. 1. In at least some embodiments, trigger 210 may comprise a single-pole single-throw momentary contact switch, or, alternatively, a fixed toggle contact switch. In at least some other embodiments trigger 210 may comprise a double-pole double-throw (DPDT) momentary contact switch, or alternatively an fixed toggle contact switch. Trigger 210 may be used by the operator to fire a weapons system. The weapons system fired by the operator using trigger 210 may be selected by positioning switch 120. Palm switch 220 may comprise a switch that acts as a safety in the sense that in its open state, i.e. when the operator is not closing the palm switch, by for example, grasping the weapon system controller handle, the weapon systems will not fire. Palm switch 220 may comprise a double pole single throw constant contact switch. Connector 230 and connector 240 may be provided in any suitable form to connect weapons system controller handle 100 circuitry to the weapons system, as described further in conjunction with FIG. 5.

Figure 3:
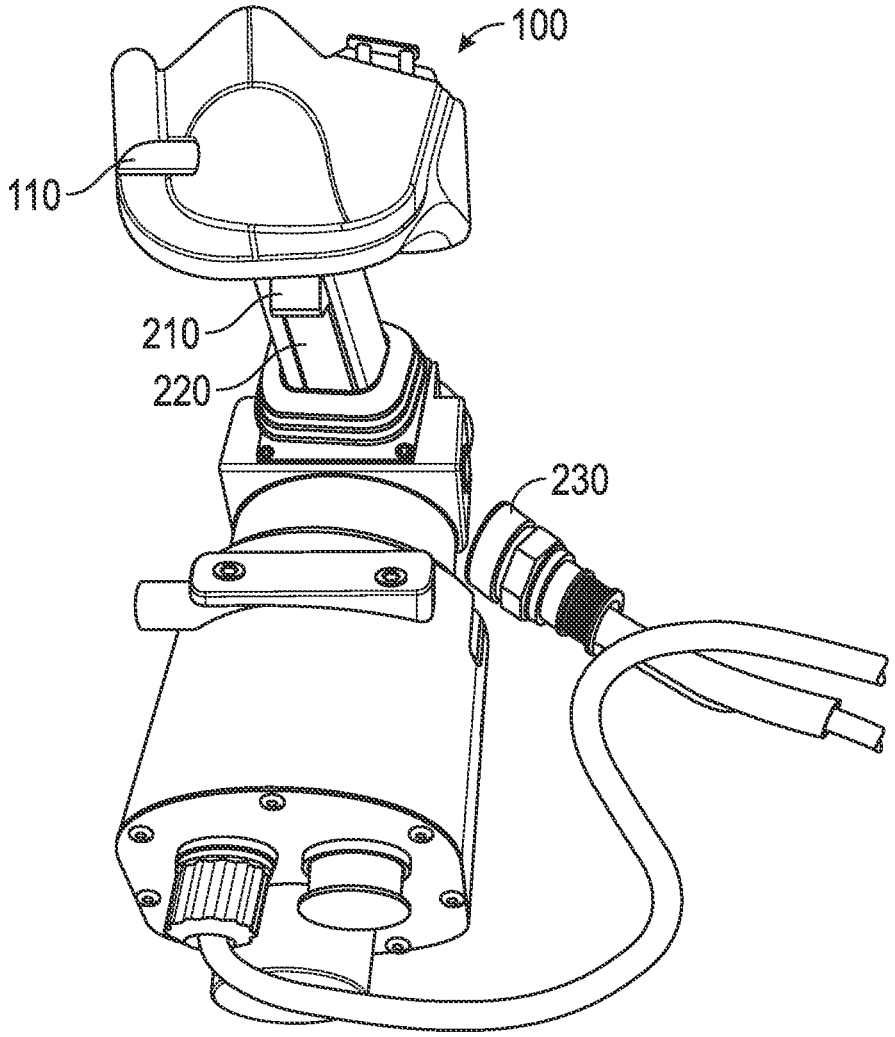
FIG. 3 shows a rear view of a weapons system control handle in accordance with at least some embodiments.
Figure 4:
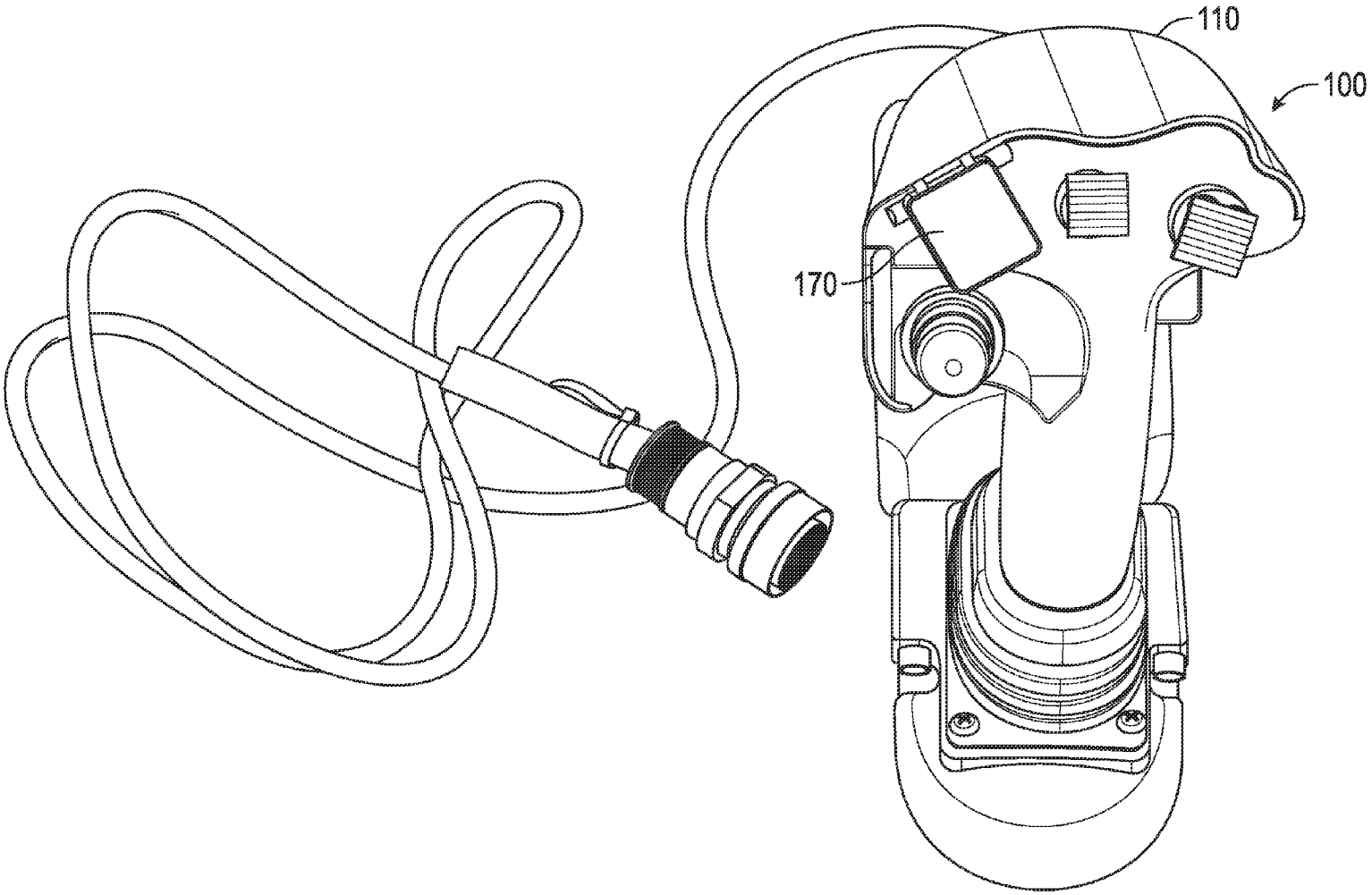
FIG. 4 shows a front view of a weapons system control handle in accordance with at least some embodiments.

FIGS. 3 and 4 show rear and front views of weapons system controller handle 100, respectively. The rear view of weapons system controller handle 100 in FIG. 3 shows trigger 210 and palm switch 220. The front view of weapons system controller handle 100 shows cover 170 in a closed position.

Figure 5A:
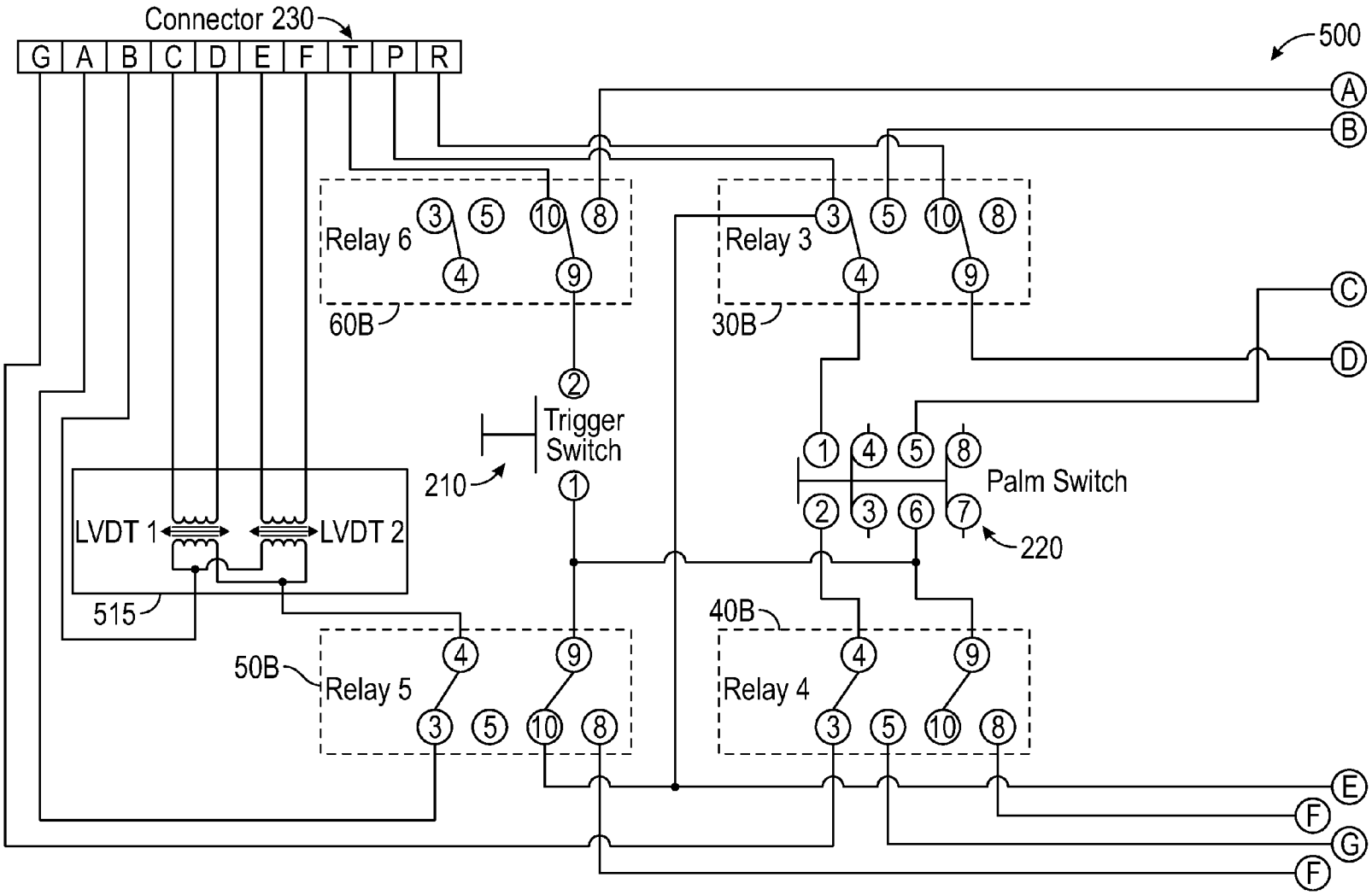
FIG. 5 (in two sheets, 5A and 5B) shows a schematic drawing of electrical circuitry in accordance with at least some embodiments.
Figure 5B:
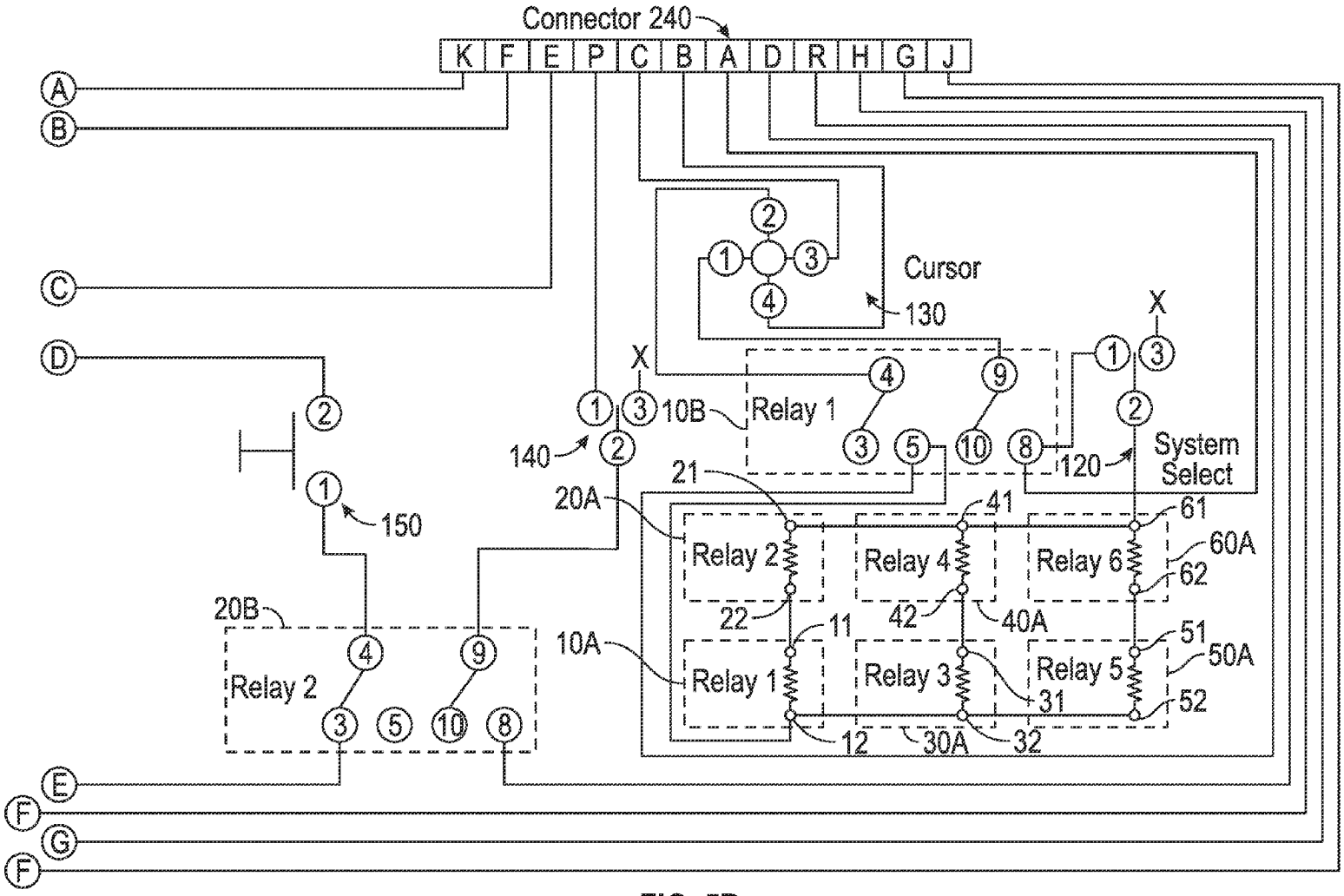

Turning to FIG. 5 (in two sheets FIG. 5A and FIG. 5B), there is shown a schematic diagram of electrical circuitry 500 which may be used for selectably controlling multiple weapon systems in accordance with at least some embodiments. Electrical circuitry 500 may be disposed within an internal volume of weapons system controller handle 100. In at least some embodiments, weapons system controller handle 100 may be constrained to have the same form factor as a preexisting weapons system controller handle. Electrical circuitry 500 may include relays 10, 20, 30 40, 50 and 60, which may be energized and de-energized by the operation of switch 120. In the exemplary embodiment of electrical circuitry 500, switch 120 may be a single-pole double throw (SPDT) switch. Relays 10, 20, 30, 40, 50 and 60 may include respective coil portions 10A, 20A, 30A, 40A, 50A and 60A, and contact portions 10B, 20B, 30B, 40B, 50B and 60B. Hereinafter, relay coil portions may simply be referred to as relay coils and the contact portions as contacts. Contacts 10B, 20B, 30B, 40B, 50B and 60B may have a double pole-double throw (DPDT) configuration. Relays 10, 20, 30 40, 50 and 60 may be interconnected in series-parallel configuration with terminals 21, 41 and 61 of relay coils 20A, 40A and 60A respectively, connected in parallel. Likewise, terminals 12, 32 and 52 of relay coils 10A, 30A and 50A may be parallel connected. Terminal 11 of relay coil 10A may be serially connected to terminal 22 of relay coil 20A. Similarly, terminal 42 of relay coil 40A and terminal 31 of relay coil 30A may be serially connected, and terminal 62 of relay coil 60A and terminal 51 of relay coil 50A may be serially connected. Terminals 21, 41 and 61 may be connected to the common terminal 2 of switch 120. Terminal 1 of switch 120 may be connected by terminal 8 of contacts 10B to terminal A of connector 240. When in operation, weapons system control handle 100 may connect to one of a plurality of weapons systems via connector 230 and 240, and power may be supplied from the weapons system to circuitry 500 via terminal A of connector 240. Connectors 230 and 240 may mate with corresponding connectors on the vehicle which are pre-existing and not configurable. In an exemplary embodiment in a M1A1 tank, connector 230 may connect to the main gun and connector 240 to the SCWS. Terminal A may provide a voltage, for example +5 volts at terminal 1 of switch 120, but other voltages may be used in alternative embodiments. The return may be provided via terminal D of connector 240, which may provide −5 volts, for example to terminals 12, 32 and 52, shown connected to terminal D of connector 240 at terminal 8 of contacts 10A. Thus, relays 10, 20, 30, 40, 50 and 60 may be energized by operation of switch 120 to close the circuit between terminals 1 and 2 thereof. As will now be described, on energization of the relays, weapon system controller handle 100, control of the weapon systems via weapon system control handle 100 switches from one of the weapon systems to the other, and conversely when by operation of switch 120, the relays are de-energized. In the exemplary embodiment of weapons system control handle 100 in an M1A1 tank, energizing the relays may switch to SCWS mode and weapon system controller handle 100 operates to control the SCWS. De-energizing the relays, may switch to main mode and weapon system controller handle 100 operates to control the main gun.

Considering first the de-energized state of relays 10, 20, 30, 40, 50 and 60, switches 150, 220 and trigger switch (or simply trigger) 210 may be connected to connector 230. Connector 230 may connect circuitry 500, to one of a plurality of weapons systems, such as the main gun in the M1A1 tank. In the example of electrical circuitry 500 the embodiment of trigger 210, comprising a SPST switch, trigger 210, may be connected to a terminal of connector 230 via the normally closed terminals (9, 10) of one pole of relay contacts 60B and 50B. Trigger 210 may be coupled to a second terminal of connector 230 via normally closed terminals (3, 4) of relay contacts 30B and relay contacts 40B. However, in each of the pair of terminals in relay contacts 30B and 40B, one terminal may be connected to terminals of a pole of palm switch 220. Thus, the circuit between the terminals of connector 230 may not be closed by closing trigger 210 unless palm switch 220 is also closed. In this way, palm switch 220 may act as a safety. Similarly, in the de-energized state of relays 10, 20, 30, 40, 50 and 60, switch 150 may be connected to a terminal of connector 230 via the normally closed terminals (9, 10) of a second pole of relay contacts 30B, and normally closed terminals (3, 4) of relay contacts 20B. Note that in the de-energized state of relays 10, 20, 30, 40, 50 and 60, power to cursor 130 may be removed with normally closed terminals of relay contacts 10B open circuited. Likewise switch 140 may be open circuited via the normally closed terminals of a second pole of relay contacts 20B. Terminals 3 and 4 of cursor 130 are respectively connected to terminals C and B of connector 240, independent of the state of switch 120.

Considering now the energized state of relays 10, 20, 30, 40, 50 and 60, switches 150, 220 and trigger 210 may be connected to connector 240. Connector 240 may connect circuitry 500, to a second of a plurality of weapons systems, such as the SCWS in the M1A1 tank. Trigger 210 may be coupled to terminals of connector 240 via normally open terminals in one of the poles in relay contacts 50B and 60B. Similarly, normally open terminals of palm switch 220 may be coupled to terminals of connector 240 via normally open terminals of relay contacts 40B and normally open terminals (4, 5) of a pole of relay contacts 30B. Switch 150, comprising an SPST switch in the embodiment of FIG. 5, may be coupled to terminals of connector 240 via normally open terminals (4, 5) of a pole of relay contacts 20B and of a second pole (9, 8) of relay contacts 30B. Switch 140 may be connected to terminals of connector 240 via the normally open terminals of a second pole of relay contacts 20B. Further, when relays 10, 20, 30, 40, 50 and 60 are de-energized, power may be applied to cursor 130 via normally open terminals in relay contacts 10B.

Further, a pair 515 of linear variable differential transformers LVDT1 and LVDT2, may be mechanically coupled to control assembly handle 100 and electrically to terminals A, B, C, D, E and F of connector 230. The mechanical coupling converts the displacements of control assembly handle 100 into electrical signals used by the weapons system coupled to connector 230 to control the position of the weapons system.

Thus, via the action of switch 120, weapons system control handle 100 may selectably effect the control of multiple weapons systems without the need for separate control devices.

Figure 6:
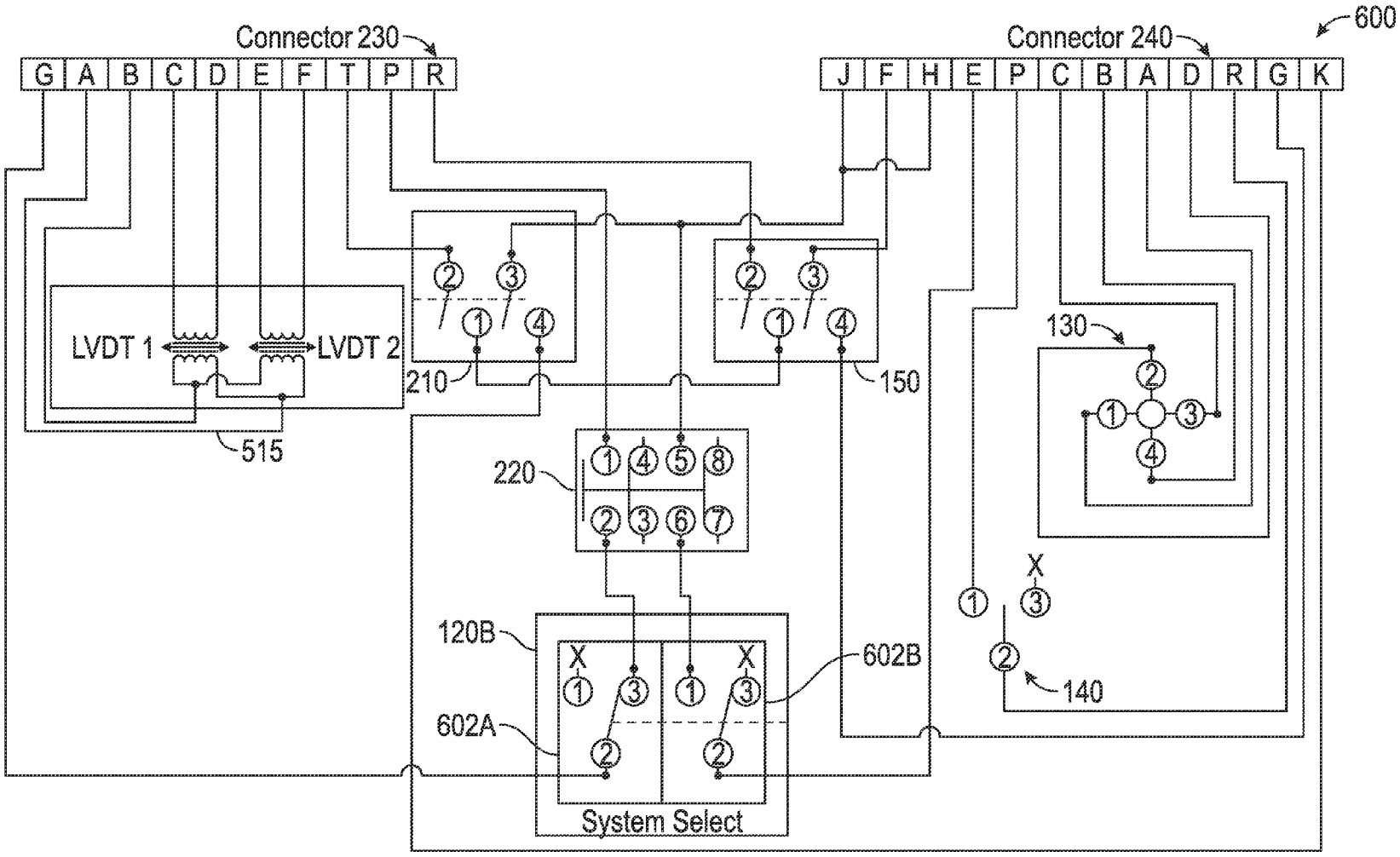
FIG. 6 shows a schematic drawing of electrical circuitry in accordance with at least some embodiments.

Refer now to FIG. 6 illustrating a schematic diagram of electrical circuitry 600 which may be used for selectably controlling multiple weapon systems in accordance with at least some other embodiments. Electrical circuitry 600 is passive in the sense that it effects the selection of a weapon system without the reliance on vehicle or system electrical power. Electrical circuitry 600 may be disposed within an internal volume of weapons system controller handle 100, In at least some embodiments, weapons system controller handle 100 may be constrained to have the same as the form factor as a preexisting weapons system controller handle. Similar to electrical circuitry 500, electrical circuitry 600 may include connectors 230 and 240 which may mate with corresponding pre-existing connectors on the vehicle and which are not configurable. Stated otherwise, electrical circuitry 500, FIG. 5, and electrical circuitry 600 may be required to conform to and integrate with existing mechanical and electrical systems within the vehicle in which they are deployed without modification thereto.

Electrical circuitry 600 includes a select switch 120 which may serve to "steer" the functionality of other controls within electrical circuitry 600 between the two weapons systems. In this way, the vehicle commander may engage either of the weapons systems from a single control handle, similar to electrical circuitry 500. In the exemplary embodiment of FIG. 6, select switch 120 may be a double-pole double-throw (DPDT) switch. Select switch 120 may include two sets of contacts, pole 602A and pole 602B. To simplify the following description, the terminals of the switches 120 will be denoted by the corresponding pole or switch, as appropriate, followed by the digit numbering the terminal in FIG. 6. A first pole, pole 602A includes a common terminal, terminal 602A-2, electrically coupled to a first terminal, terminal G of connector 230. Another terminal of pole 602A, terminal 602A-3 is coupled to a first terminal, terminal 220-2 of a first terminal pair (1, 2) of switch 220. A second terminal, terminal 220-1, of the first terminal pair of switch 220 is coupled to a second terminal, terminal P, of connector 230. Returning to select switch 120, a common terminal 602B-2 of pole 602B is coupled to a first terminal, terminal E, of connector 240. Another terminal, terminal 602B-1 of pole 602B is coupled to a third terminal, terminal 220-6, of switch 220. A fourth terminal, terminal 220-5 of switch 220 is coupled to second and third terminals, J and H, of connector 230. The remaining terminals of switch 120, terminal 602A-1 of contact set 602A and 602B-3 of contact 602B and the remaining terminals of switch 220, terminals 220-3, 220-4, 220-7 and 220-8 may be open.

The exemplary embodiment of electrical circuitry 600 also includes a trigger 210, which may comprise a double pole double throw momentary contact switch, in the embodiment of FIG. 6. One pole of trigger 210, comprises terminals 210-1 and 210-2 of trigger 210. Terminal 210-1 couples to switch 150 as described below. Terminal 210-2 couples to terminal T of connector 230, to effect the firing of the weapons system associated with connector 230, when switch 120 is positioned to select that weapons system. The other pole of trigger 210 comprises terminals 210-3 and 210-4. Terminal 210-3 couples to terminals J and H of connector 240 and terminal 210-4 couples to terminal K of connector 240 to effect the firing of the weapons system associated with connector 240, when switch 120 is positioned to select that weapons system.

Another device that may be included is switch 150. Switch 150 may be a double-pole single-throw (DPST) switch in the embodiment of electrical circuitry 600. Similar to switch 150, FIG. 5, switch 150 may select different functionality depending on the position of switch 120, as described above in conjunction with FIGS. 1 and 5. One pole of switch 150 includes terminals 150-1 and 150-2 which couple respectively to terminal 210-1 of switch 210 and terminal R of connector 230. A second pole of switch 150 includes terminals 150-3 and 150-4 which couple to terminals F and G of connector 240, respectively.

Further, electrical circuitry 600 may include pre-existing components associated with one or both weapons systems. For example, a cursor (or "trackball") 130 having terminals 1-4 coupled to terminals A, D, C and B, respectively, of connector 240 to control the positioning of the weapons system coupled to connector 240, as described above in conjunction with FIG. 5. Also, similar to electrical circuitry 500, a pair 515 of linear variable differential transformers LVDT1 and LVDT2, may be mechanically coupled to control assembly handle 100 and electrically to terminals A, B, C, D, E and F of connector 230. The mechanical coupling converts the displacements of control assembly handle 100 into electrical signals used by the weapons system coupled to connector 230 to control the position of the weapons system. Also included is switch 140, as described above in conjunction with FIGS. 1 and 5. A first terminal of switch 140, terminal 140-1 is connected to terminal P of connector 240, and a second terminal, terminal 140-2 is connected to terminal R of connector 240. A third terminal, terminal 140-3, may be unused in the exemplary embodiment of FIG. 6.

The various embodiments refer to a weapons system, but are not solely limited to such a system, and may be implemented on any system. References to "one embodiment", "an embodiment", "a particular embodiment", "some embodiments", "various embodiments", and "example embodiments" indicate that a particular element or characteristic is included in at least one embodiment of the invention. Although the illustrative phrases may appear in various places, these do not necessarily refer to the same embodiment.

The above discussion is meant to be illustrative of the principles and various embodiments of the present invention. Numerous variations and modifications will become apparent to those skilled in the art once the above disclosure is fully appreciated. For example, the role of the normally-open and normally closed contacts of the various relays could be interchanged along with interchanging the weapons system selected by the open and closed position of the selector switch, however the principles disclosed herein are the same. It is intended that the following claims be interpreted to embrace all such variations and modifications.

What is claimed is:

1. An apparatus comprising:

a trigger switch;

a first relay having a double throw contact, the common terminal of the double throw contact of the first relay coupled to a first terminal of the trigger switch; and a second relay having a double throw contact, the common terminal of the double throw contact of the second relay coupled to a second terminal of the trigger switch; wherein:

when the first relay is in the un-energized state, the common terminal of the double throw contact of the first relay is further connected to a first terminal of the double throw contact of the first relay, the first terminal of the double throw contact of the first relay coupled to a first terminal of a connector coupled to a first weapons system; and when the first relay is in the energized state, the common terminal of the double throw contact of the first relay is further connected to a second terminal of the double throw contact of the first relay, the second terminal of the double throw contact of the first relay coupled to a first terminal of a connector coupled to a second weapons system; and when the second relay is in the energized state, the common terminal of the double throw contact of the second relay is further connected to a first terminal of the double throw contact of the second relay, the first terminal of the double throw contact of the second relay coupled to the connector coupled to the second weapons system.

2. The apparatus of claim 1 further comprising a first switch, wherein, when the first switch is in a first position, the first relay is un-energized, and when the first switch is in a second position, the first relay and the second relay are energized.

3. The apparatus of claim 1 further comprising:

a third relay having a first pole, wherein:

a first terminal of the first pole of the third relay is coupled to a second terminal of the connector coupled to the first weapon system, and a common terminal of the of the first pole of the third relay is coupled to a first terminal of a first pole of a second switch; and a second terminal of the first pole of the third relay is coupled to a second terminal of the connector coupled to the second weapons system; and wherein:

the common terminal of the first pole of the third relay is further coupled to the first terminal of the first pole of the third relay when the first switch is in the first position; and the common terminal of the first pole of the third relay is further coupled to the second terminal of the first pole of the third relay when the first switch is in the second position;

a fourth relay having a first pole, wherein:

a common terminal of the first pole of the fourth relay is coupled to a second terminal of the first pole of the second switch;

a first terminal of the first pole of the fourth relay is coupled to a third terminal of the connector coupled to the first weapon system; and a second terminal of the first pole of the fourth relay is coupled to a third terminal of the connector coupled to the second weapons system, and wherein:

the common terminal of the first pole of the fourth relay is further coupled to the first terminal of the first pole of the fourth relay when the first switch is in the first position; and the common terminal is further coupled to the second terminal of the first pole when the first switch is in the second position.

4. An apparatus comprising:

electrical circuitry configured to selectably control the operation of a first weapon system and a second weapon system different from the first weapon system, the electrical circuitry comprising:

a first switch comprising a first pole and a second pole;

a first connector having a first terminal coupled to a common terminal of the first pole;

a second connector having a first terminal coupled to a common terminal of the second pole, wherein:

the first connector is configured to couple to a first weapon system mounted on a mobile platform; and the second connector is configured to couple to a second weapon system mounted on the mobile platform; and, wherein the first weapon system is configured to operate when the first switch is in a first position and the second weapon system is configured to operate when the first switch is in a second position.

5. The apparatus of claim 4, the electrical circuitry further comprising:

a second switch comprising:

a first terminal of a first pole coupled to a first terminal of the first pole of the first switch, and a second terminal of the first pole coupled to a second terminal of the first connector; and a first terminal of a second pole coupled to a first terminal of the second pole of the first switch, and a second terminal of the second pole coupled to second and third terminals of the second connector; and wherein:

the common terminal of the first pole of the first switch is further coupled to the first terminal of the first pole of the second switch when the first switch is in the first position, and the common terminal of the second pole of the first switch is further coupled to the first terminal of the second pole of the second switch when the first switch is in the second position.

6. The apparatus of claim 5 further comprising a third switch, wherein:

the third switch comprises:

a first pole having a first terminal coupled to the second and third terminals of the second connector, and a second terminal coupled to a fourth terminal of the second connector, and a second pole having a first terminal coupled to a third terminal of the first connector.

7. The apparatus of claim 6 wherein the third switch comprises a momentary contact switch, and when the first switch is in the first position, the apparatus is configured to fire the first weapon system on actuation of the third switch, and when the first switch is in the second position, the apparatus is configured to fire the second weapons system on actuation of the third switch.

8. The apparatus of claim 7 further comprising a control handle housing, wherein the control handle housing comprises a pre-existing form factor, the first, second and third switches disposed within the control system housing.

* * * * *